US011932459B2

(12) United States Patent
Lenz et al.

(10) Patent No.: US 11,932,459 B2
(45) Date of Patent: Mar. 19, 2024

(54) CLOSURE FOR A CONTAINER AND CONTAINER WITH SUCH A CLOSURE

(71) Applicant: Aptar Freyung GmbH, Freyung (DE)

(72) Inventors: Franz Lenz, Hinterschmiding (DE); Magdalena Orasche, Freyung (DE); Andreas Rueckert, Ringelai (DE); Bruno Koenigseder, Roehrnbach (DE)

(73) Assignee: Aptar Freyung GmbH, Freyung (DE)

( * ) Notice: Subject to any disclaimer, the term of this patent is extended or adjusted under 35 U.S.C. 154(b) by 32 days.

(21) Appl. No.: 17/912,761

(22) PCT Filed: Apr. 7, 2020

(86) PCT No.: PCT/EP2020/059863
§ 371 (c)(1),
(2) Date: Sep. 19, 2022

(87) PCT Pub. No.: WO2021/204360
PCT Pub. Date: Oct. 14, 2021

(65) Prior Publication Data

US 2023/0135445 A1 May 4, 2023

(51) Int. Cl.
*B65D 47/08* (2006.01)

(52) U.S. Cl.
CPC ..... *B65D 47/0838* (2013.01); *B65D 2401/20* (2020.05); *B65D 2401/45* (2020.05)

(58) Field of Classification Search
CPC ..... B65D 47/0838; B65D 2401/20; B65D 2401/45; B65D 47/02; B65D 47/0243;
(Continued)

(56) References Cited

U.S. PATENT DOCUMENTS 4,512,484 A 4/1985 Mar
10,138,037 B2 * 11/2018 Migas ..... B65D 51/145
(Continued)

FOREIGN PATENT DOCUMENTS

EP 2207729 B2 7/2011
EP 4008648 A1 6/2022
(Continued)

OTHER PUBLICATIONS

Written Opinion and Search Report dated Dec. 23, 2020 for PCT/EP2020/059863 of which this is subject application a US National Phase.

(Continued)

*Primary Examiner* — Kareen K Thomas
(74) *Attorney, Agent, or Firm* — Wood, Phillips, Katz, Clark & Mortimer

(57) ABSTRACT

The present invention relates to a closure for a container with a base element directly or indirectly attachable to a container, a flip-top lid attached to the base element by a hinge such that the flip-top lid can be moved between an opened and a closed position, and a tamper evident element for indicating whether the flip-top lid had been opened at least once by a user or not. The flip-top lid comprises a top cover element and an outer side wall extending therefrom. The tamper evident element is linearly movable between a first position and a second position, wherein the flip-top lid further comprises an inner side wall, which extends only around a part of the circumference of the closure, wherein at least parts of the inner side wall and at least parts of the outer side wall together form guidance means for enabling and controlling the linear movement.

23 Claims, 9 Drawing Sheets

(58) Field of Classification Search
CPC ..... B65D 47/0246; B65D 47/061; B65D 47/065; B65D 47/066; B65D 47/0804; B65D 47/0809; B65D 47/0814; B65D 47/0819; B65D 47/0823; B65D 47/0828
See application file for complete search history.

(56) References Cited

U.S. PATENT DOCUMENTS

| | | | | |
|---|---|---|---|---|
| 10,399,753 | B1 * | 9/2019 | Migas | B65D 51/245 |
| 2006/0011573 | A1 | 1/2006 | Herald et al. | |
| 2018/0312305 | A1 * | 11/2018 | Rognard | B65D 47/0852 |
| 2018/0319551 | A1 * | 11/2018 | Ferrari | B65D 47/242 |
| 2019/0009943 | A1 * | 1/2019 | Komet | B65D 1/0246 |
| 2019/0023465 | A1 * | 1/2019 | Schmid | B65D 47/0838 |
| 2019/0119008 | A1 * | 4/2019 | Berroa Garcia | B65D 47/0885 |
| 2019/0256257 | A1 * | 8/2019 | Kutsuzawa | B65D 47/0838 |
| 2019/0270554 | A1 * | 9/2019 | Maeda | B65D 47/32 |

FOREIGN PATENT DOCUMENTS

| | | | |
|---|---|---|---|
| WO | 2006020059 | A2 | 2/2006 |
| WO | 2013023742 | A1 | 2/2013 |
| WO | 2015049066 | A1 | 4/2015 |
| WO | 2019092602 | A1 | 5/2019 |

OTHER PUBLICATIONS

Communication of a notice of opposition dated Nov. 29, 2022 for the counterpart European Patent No. 3921246.

* cited by examiner

CLOSURE FOR A CONTAINER AND CONTAINER WITH SUCH A CLOSURE

FIELD OF THE INVENTION

The present invention relates to a closure or a closure device for a container and to a container with such a closure or closure device.

BACKGROUND OF THE INVENTION

Such closures are typically used for dispensing products contained in a container to which said closure is attached.

The products to be dispensed are typically fluid products, like e.g. liquids or powdered or granular products, e.g. in the food or beverage area, but also in other applications, e.g. for cleaning substances, detergents or other products.

The present invention especially relates to a closure having a flip-top lid being attached to a base element by a hinge, while such a flip-top lid can be moved between an opened and closed position, while said flip-top lid is typically rotated around said hinge between its opened and its closed position.

Such closures are for example known from EP 2 121 466 B1 or from WO 2013/023742 A2.

It is an object of the present invention to provide an enhanced closure or closure device and an enhanced system with an enhanced tamper evident system for indicating whether the flip-top lid had been opened at least once by a user or whether it is still in its original, unopened status.

BRIEF SUMMARY OF THE INVENTION

This object is solved by a closure for a container according to claim 1 and by a container with such a closure according to claim 22. Claims 2 to 21 refer to specifically advantageous realizations of the closure according to claim 1. The present invention also relates to a method for manufacturing such a closure according to claim 23.

According to the present invention the closure for a container comprises a base element and a flip-top lid, which is, directly or indirectly, attached to said base element by means of a hinge. This connection or attachment of the flip-top lid to the base element is realized such that the flip-top lid can be moved between an opened and a closed position.

Preferably the base element has a skirt with attachment means for attaching the closure to a container. The attachment means may comprise an inner or an outer thread for interaction with a corresponding thread at a container, especially a neck of a container. The closure can also be realized as a snap-on closure comprising a snap-on bead for attachment to a container, preferably a neck of a container. However, it is also possible that closure and container are an integrated or unitary element, and it is also possible that the closure is attachable to a container, preferably to a neck of a container, by other fastening means, for example by application of heat, gluing or other means.

Said flip-top lid comprises a top cover element and an outer side wall extending therefrom.

In the sense and in connection with the description of the closure according to the present invention, the closure has a vertical axis or z-axis, extending in a vertical direction. In case of a base element, which has an essentially cylindrical outer form or a cylindrical skirt, as it is typically or frequently the case, see also the embodiment shown later on in this specification, this vertical axis or z-axis is also the longitudinal axis of this cylindrically formed base element or skirt. The upward direction of this vertical axis or z-axis is the direction where the flip-top lid is positioned, the flip-top lid defining an upper part of the closure, whereas the downward direction of this vertical axis or z-axis is the direction where the base or base element is positioned, defining a lower part of the closure. The lower part of the closure is therefore the part of the closure which is attached or attachable to a container, whereas the upper part of the closure is the part of the closure where the flip-top lid is arranged, at an opposite side of the part of the closure which is attached or attachable to a container.

In addition to this vertical axis or z-axis, there are also two horizontal axes, a cross axis or x-axis and a longitudinal axis or y-axis, being normal to each other and being normal to the vertical axis or z-axis, thereby defining a coordinate system. The longitudinal axis or y-axis extends through the middle of the closure and through the middle or the center of the hinge, whereas the cross axis or x-axis extends normal thereto. The x-axis and the y-axis thereby also define radial directions when considering a closure which has an essentially circular form.

The closure comprises a tamper evident element for indicating whether the flip-top lid had been opened at least once by a user or not, wherein said tamper evident element is movable between a first position and a second position and wherein said tamper evident element is in its first position when said closure is in its as-manufactured status or when said flip-top lid has not been opened yet by a user and wherein said tamper evident element is operable by a user to be moved from its first position into its second position and to concurrently move said flip-top lid for the first time from of its closed position into its opened position.

The closure according to the present invention is arranged such that said tamper evident element is, preferably unremovably (or undetachably), especially during normal operation of the device, attached to said flip-top lid, and it is also arranged such that it is linearly movable from its first to its second position, relative to said flip-top lid or relative to other parts or specific parts of said flip-top lid, like e.g. the top cover element or the outer side wall of said flip-top lid.

According to the present invention said flip-top lid further comprises an inner side wall, which extends only around a part of the circumference of said closure or said flip-top lid, wherein at least part of said inner side wall and at least parts of said outer side wall together form guidance means for enabling and/or controlling the linear movement of said tamper evident element from its first position to its second position.

Furthermore said tamper evident element is, in its as-manufactured status or when said flip-top lid has not been opened for the user yet or for the first time, frangibly connected to said base element by at least one frangible bridge, preferably by multiple frangible bridges, being spaced apart from each other.

Furthermore said tamper evident element comprises a first latch element and said flip-top lid comprises second latch element, wherein said first and said second latch elements are arranged such that they keep or latch the tamper evident element in its second position once the tamper evident element has been moved into its second position for the first time.

Such a closure of the present invention has the advantage that the tamper evident element not only has clearly defined first and second positions, but also the movement of the tamper evident element itself between the first position and the second position is clearly defined, which gives a more clear indication and feedback to any user.

Furthermore the tamper evident element is preferably unremovably or undetachably connected to the closure, so that is always kept together with the closure, more specifically it is always kept together with the flip-top lid of the closure, avoiding separate plastic parts thereby being especially environmentally friendly.

Furthermore, the tamper evident element is kept at or in the flip-top lid, thereby separate from the base element and a spout or a dispensing opening at the base element of the closure, so that it does not disturb the dispensing process.

Another advantage is that the tamper evident element is fixed in its second position by latch elements, so that there is no movement of the tamper evident element after the closure has been opened by a user, thereby avoiding any rattling or noise, which otherwise could be created when the tamper evident element is moving, e.g. in a pocket or in a void of a closure, after a first opening.

Furthermore the tamper evident element is directly operable by a user, in other words, the user can directly operate the tamper evident element when opening the closure for the first time. The user thereby can move the tamper evident element out of its first position, thereby destroying the frangible bridge or the multiple frangible bridges connecting the tamper evident element to said base element in its as-manufactured status, while due to the fact that the user directly operates the tamper evident element a more direct feedback of the breaking of the frangible connection is given to the user.

By the same operational movement the user can also move the flip-top lid out of its closed position into its opened position. The user can therefore initiate only one operation and does not have to initiate two separate steps or separate activities or movements for destroying or removing a tamper evident element on the one hand and for opening the flip-top lid at the other hand. The user only has to initiate said one "operational activity", which automatically first destroys the frangible bridges by which the tamper evident element is attached to the base element, moves the tamper evident element from its first into its second position and to concurrently moves the flip-top lid from its closed position to its opened position. Due to the specific arrangements of all elements this one "operational activity" to be initiated by the user is also the movement or "activity", the user would intuitively apply in order to open a closure with a flip-top lid.

The user can therefore intuitively operate the closure, even if operating it for the first time, and he will automatically, during the complete operation of opening the flip-top lid for the first time, receive very clear indications about every step: the breaking of the frangible bridges, the controlled movement of the tamper evident element from its first position into its second position and the concurrently occurring opening of the flip-top lid for the first time. This is a remarkable enhancement especially in comparison to closures where the tamper evident element can either not be directly operated by a user or wherein at least not all positions of the tamper evident element are fixed in every stage, both with respect to the starting and end positions (first and second positions) and with respect to the movement between these positions.

According to a preferred embodiment said base element has a recessed portion, preferably a radially recessed portion, which extends only around a part of the circumference of said closure. Said recessed portion is arranged such that the said tamper evident element extends at least partly into said recessed a portion of said base element, when said tamper evident element is in its first position. Such an arrangement has the advantage that said tamper evident element is protected within said recessed portion, while the form of the overall closure gives a unitary appearance.

Furthermore, said closure is preferably arranged such that said tamper evident element is at least partly retracted out of said recessed portion, when being moved from its first position into its second position, so that said recessed position is visible or empty, thereby changing the unitary appearance of the closure and clearly indicating a different status, namely a status indicating that said closure has been opened at least once.

Preferably said base element comprises an indicator portion being arranged in said recessed portion, wherein said indicator portion is arranged such that it is not visible when said tamper evident element is in its first position but that it is visible when said tamper evident element is in its second position. The indicator portion preferably bears a mark clearly indicating to the user that the tamper evident element has been moved, and it would be e.g. possible to provide an indicator portion which bears the word "OPEN". Beside the very clear indication effect to the user, it is also a specific advantage that this indicator portion is part of the base element, so that it is also clearly visible in any position of the flip-top lid. This arrangement also ensures that the dimensions of the flip-top lid by itself can be kept relatively small while still keeping a relatively large indicator portion by using the available dimensions of the base element. Furthermore the indication effect is achieved separate from the tamper evident element itself (in its second position) or, if the tamper evident element is used separately and/or additionally for indicating that the closure has been opened at least once, there is an additional indication effect, at a different part or location of the closure, which remarkably enhances the indication to a user whether the closure has been opened once or not.

Preferably, a radially inner surface of said outer side wall comprises a longitudinally extending guidance groove and wherein a radially outer surface of said tamper evident element comprises a protrusion, said guidance groove and said protrusion are arranged such that said protrusion at least partly extends into said guidance groove, preferably for guiding or controlling the linear movement of said tamper evident element between its first position and its second position or for supporting such guiding or controlling. The longitudinal guidance groove extends preferably in a vertical direction or in a direction along a z-axis, when considered or viewed in a situation where the flip-top lid is in its closed position. Such an arrangement further supports the controlled movement of the tamper evident element, and it also provides a higher security against a potential manipulation of the tamper evident element.

Further preferably, said guidance groove comprises a latching protrusion being arranged such that it interacts with said protrusion of said tamper evident element (or alternative another word separate protrusion or element of said tamper evident element), when said tamper evident element is in its second position, such that said tamper evident element is latched in its second position. Such an arrangement provides secure latching of the tamper evident element in its second position, especially as said latching is provided at inner parts of the closures, so that additionally manipulations can be securely prevented.

In a further preferred embodiment said outer side wall and said inner side wall of said flip-top lid are arranged such that a lower edge of either the outer side wall or of said inner side wall or a lower edge of both said outer side wall and said inner side wall abut the base element over the complete circumference of the closure (or at least over about 90% or at least 80% of the circumference of the closure), when said flip-top lid is in its closed position. Thereby a specific sealing effect is achieved, preventing or minimizing dust or dirt from entering into an area between flip-top lid and base when said flip-top lid is in its closed position, thereby remarkably enhancing the hygienic situation also in an unclean environment.

In a preferred embodiment, said tamper evident element comprises an actuating protrusion suitable for being operated by a user to move the tamper evident element from its first position to its second position, when opening the closure for the first time, and to move the flip-top lid out of its closed position. Preferably, said actuating protrusion extends from a radial outward surface of said tamper evident element into a radially outward direction. Further preferably, said actuating protrusion extends, in a circumferential direction, over at least 70% of the circumferential extension of the tamper evident element, preferably over at least 80% or even over at least 90% of the circumferential extension of the tamper evident element. Such a realization enhances the ease of operability for the user, making it easier for the user to directly operate the tamper evident element and for enhancing feedback during operation, especially during first opening of the flip-top lid.

Further preferably, such an actuating protrusion is arranged such that it abuts against the lower edge of the outer side wall of the flip-top lid when being in its second position. This further enhances the controlled movement of the tamper evident element, especially a controlled movement into its second position and thereby also a controlled latching of the tamper evident element when being moved into its second position. Preferably the lower edge of the outer side wall and an edge or a boarder or an upper or vertically upper end of the actuating protrusion have congruent forms, so that the abutment occurs over the complete or essentially the complete extension of the actuating protrusion.

In a very specifically preferred embodiment, said flip-top lid comprises a through hole or an opening or a slit being arranged such that said tamper evident element extends at least partly through or out of said slit or through hole or opening, when said tamper evident element is in its second position, and such that said tamper evident element does not extend through said slit, when said tamper evident element is in its first position. Such a slit is preferably provided in the top cover element of said flip-top lid, but it is also possible that the slit extends at least partly into the outer side wall of said flip-top lid. There may be also embodiments in which there is a continuous transition between the top cover element of said flip-top lid and the outer side wall, e.g. a curved edge portion between top cover element and the outer side wall. The slit or through hole may, in one embodiment, also be arranged fully or partly in such a transition area, especially in a curved edge portion between top cover element and the outer side wall.

Such an arrangement gives a specifically clear indication to a user that the tamper evident element is in its second position, clearly indicating that the frangible bridges have been broken and the closure has been or could have been opened at least once. A very important advantage is that the tamper evident element extending through said slit to the outside or upper side, beyond the outer surface of the flip-top lid, especially beyond the outer surface of the top cover element or the outer surface of the outer side wall or beyond an outer surface of a transition area or edge between these two elements, is clearly visible essentially from all sides, e.g. also when viewing the closure from a backside, where the hinge is arranged.

Another advantage is that the extension of the tamper evident element beyond the outer surface of flip-top lid can also be felt or sensed with fingers, which is a specific advantage for blind users or for users with poor eyesight.

In this respect it has to be mentioned that in a specific embodiment the tamper evident element may extend into said slit or through hole even when being in its first position, however it extends only into an inner area of the slit within the thickness of the material of the flip-top lid, but not beyond an outer surface of the flip-top lid, or, in other words out of the slit dimensions itself.

In another alternative embodiment said flip-top lid comprises also a slit, but being arranged such that said tamper evident element extends at least partly into said slit but not through said slit, when said tamper evident element is in its second position, and such that said tamper evident element does not extend into said slit, when said tamper evident element is in its first position, or, further alternatively, wherein said flip-top lid also comprises a slit being arranged such that said tamper evident element is moved closer to said slit when being moved from its first position to its second position without extending into said slit or through said slit.

In these alternative embodiments, the tamper evident element does not extend through said slit and not beyond an outer surface of the flip-top lid or, in other words, out of the slit dimensions itself, independent of the position of the tamper evident element and even in the second position. However, due to the fact that the tamper evident element extends either into said slit or in an area within the thickness of the material of flip-top lid (without extending through said slit and to the outer area or beyond an outer surface of the flip-top lid), or at least closer to said slit, when being in its second position, the tamper evident element is remarkably better visible when being in its second position when compared to a situation in which the tamper evident element is in its first position. Such a visibility could be, in a further preferred embodiment, even increased by realizing the tamper evident element in a specific color, being different from the color of the other parts of the flip-top lid. The flip-top lid could be e.g. realized in a white or gray color, while the tamper evident element could be realized in a red color.

In a further preferred embodiment of a closure with a slit in the flip-top lid the tamper evident element comprises at least one additional latching element, which interacts with a part or parts of said flip-top lid, preferably with a part or parts of said top cover element (or said outer side wall or a transition or edge area between top cover element and outer side wall) of said flip-top lid, such that a latching effect or an additional latching effect is achieved, latching or keeping the tamper evident element in its second position, once the tamper evident element has been moved into its second position for the first time. Such an arrangement additionally secures that any manipulation of the tamper evident element is avoided.

In a further embodiment said top cover element (or a part of the outer side wall or a transition region or area between the top cover element and the side wall, e.g. a curved edge) of said flip-top lid comprises a deepening or indentation extending over a portion of said top cover element. In case of an embodiment comprising a slit in said flip-top lid, especially in said top cover element of said flip-top lid, as described above, the slit is preferably provided solely within said deepening or indentation. This ensures that those parts of the tamper evident element extending beyond the slit, when said tamper evident element is in its second position, are nevertheless partly protected by other parts of the closure or specifically the flip-top lid, while still being clearly visible or sensible.

In a further preferred embodiment said top cover element of said flip-top lid comprises at least one, preferably two, flat surfaces forming a standing surface or a platform for allowing a closure or a container connected to said closure to be arranged in an upside down position. Such a realization is especially important for specific products to be dispensed from a container, e.g. in the food and beverage area but also in other areas like cosmetics or beauty and care.

In case of an embodiment in which said flip-top lid is provided with a slit through which tamper evident element at least partly extends when being in its second position, the closure is preferably arranged such that said tamper evident, when being in its second position, does not extend beyond the plane defined by said at least one, preferably by said two, flat surfaces of said top cover element. This ensures that the closure or the container with the closure can be still stored or placed in its upside position even when the tamper evident element is in its second position.

According to a further embodiment such a deepening or indentation of the flip-top lid has the form of a trench extending radially over the complete top cover element, preferably in a direction from a circumferential position of the closure where the hinge is positioned to a circumferential position of the closure opposite to the hinge, so that this trench or indentation extends essentially parallel to the y-axis. This realization makes the tamper evident element when being in its second position and when extending through said slit especially well visible from the backside of the closure.

According to a further especially preferred embodiment, parts of said inner side wall and parts of said outer side wall together form guidance means and a channel in which said tamper evident element can be moved, wherein there is at least one bridging element provided in said channel, connecting said inner side wall and said outer side wall, wherein said tamper evident element has at least one corresponding slit through which said at least one bridging element extends. The thickness of this channel is preferably adapted to the thickness of the tamper evident element, so that the tamper evident element is guided such that it can essentially only move in a longitudinal direction linearly between its first position and its second position, avoiding or minimizing movement in other directions. This further ensures a proper functioning, especially a proper and controlled movement of the tamper evident element within the channel, and it also provides additional protection against any possible manipulation of the tamper evident element and the closure.

According to a further preferred embodiment, the tamper evident element comprises an indicator portion being arranged at a radial outer surface of said tamper evident element such that said indicator portion of said tamper evident element is visible when said tamper evident element is in its first position and which is not visible and covered by the outer side wall of said flip-top lid, when said tamper evident element is in its second position. This provides an even further indicator for the user, which additionally ensures that the user always knows about the status of the closure, from whatever direction the user is looking onto the device.

The invention also relates to a container with the closure as described above and to a method for manufacturing a closure, wherein preferably said base element and said flip-top lid are manufactured by injection molding in an opened status, with said flip-top lid being in its opened position.

BRIEF DESCRIPTION OF THE DRAWINGS

These and other advantages of the closure and the system according to the present invention will become even more apparent in view of the following figures showing a preferred embodiment of a closure according to the present invention.

DETAILED DESCRIPTION OF THE PREFERRED EMBODIMENTS

Figure 1:
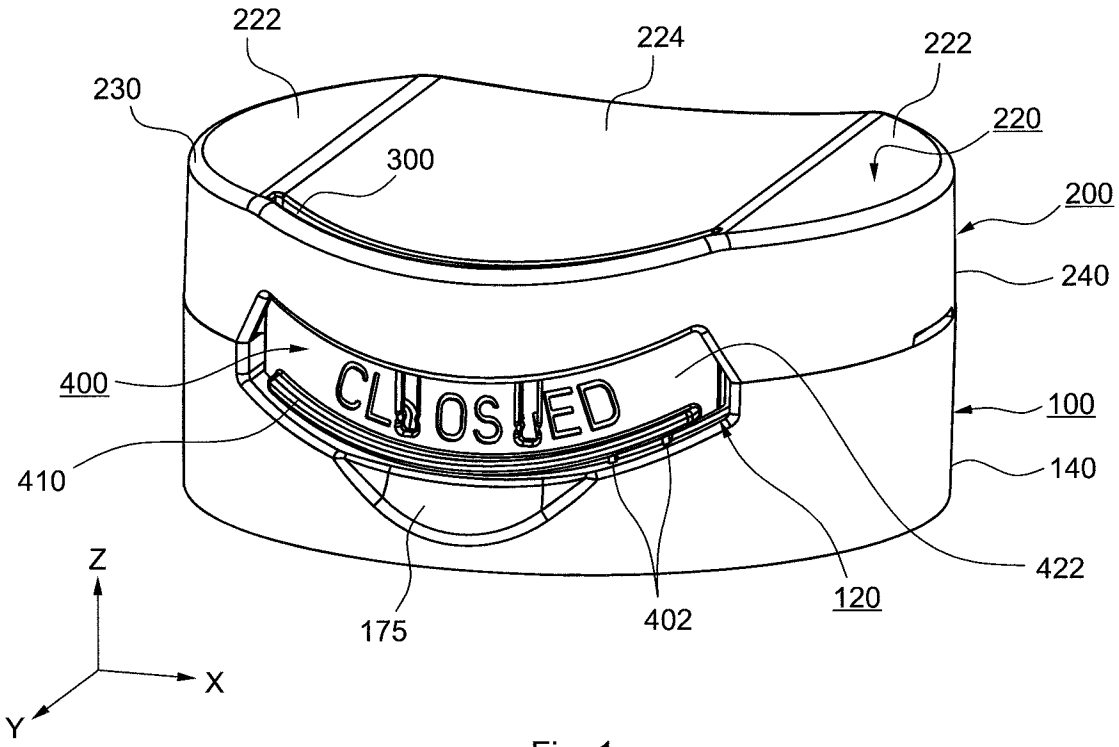
FIG. 1 shows a perspective view of an embodiment of the closure according to the present invention with the flip-top lid in its closed position and with the tamper evident element in its first position.
Figure 5:
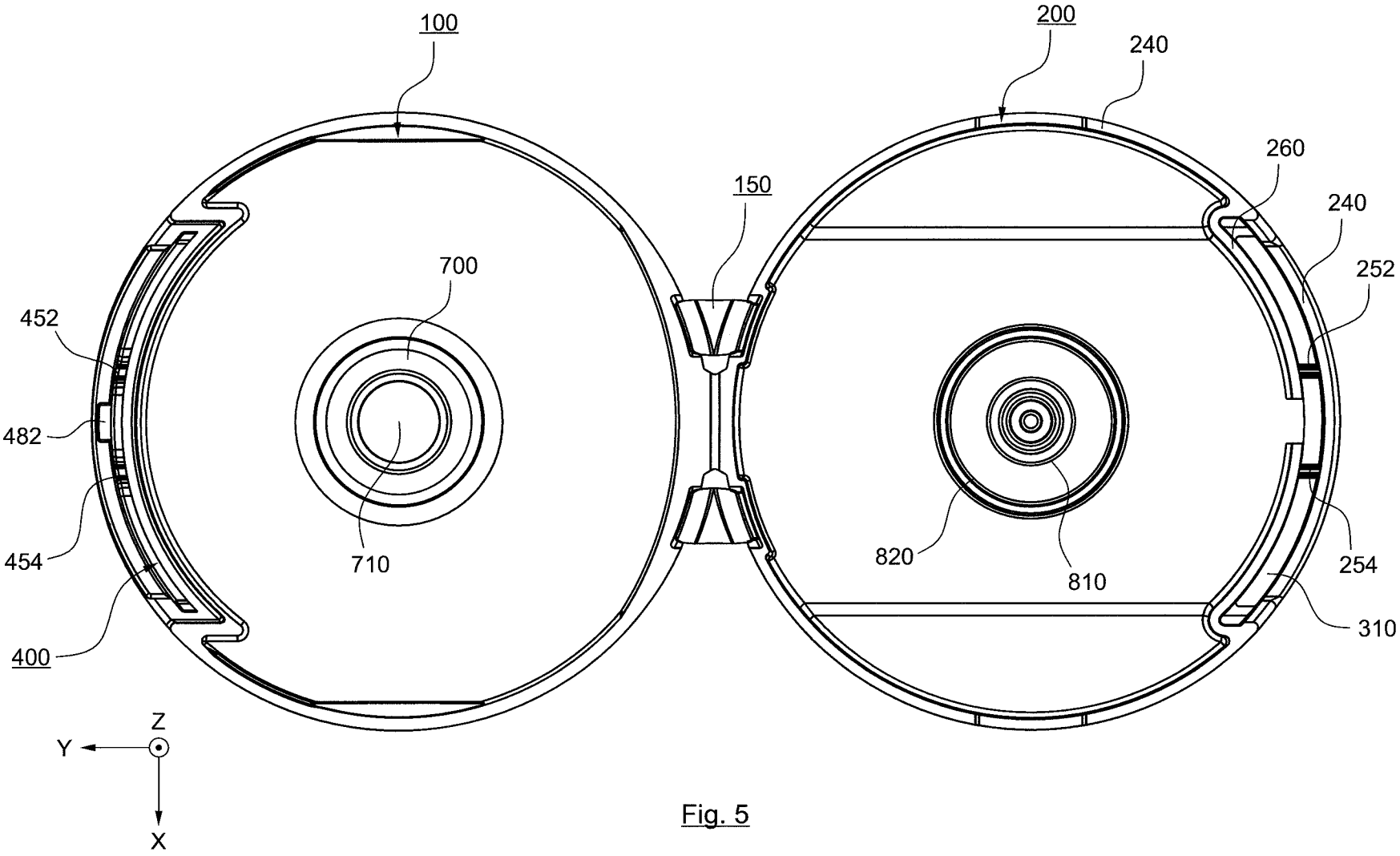
FIG. 5 shows a top view of the device as shown in FIG. 4.

FIG. 1 shows an embodiment of a closure 10 with a base element 100 and a flip-top lid 200 being attached to said base element 100 by a hinge (150, see FIG. 5). Said flip-top lid 200 comprises a top cover element 220 and an outer side wall 240 extending therefrom.

Between the top cover element 220 and the outer side wall 240 there is curved transition portion or edge portion 230, which, in this embodiment, extends around the complete circumference of the closure 10. The top cover element 220 furthermore comprises a deepening or indentation 224, extending like a trench over the complete radial extension of the top cover element 220, from an area where the hinge is located to the opposite side (along the a-axis), so that the indentation 224 forms a trench which extends in a direction being perpendicular to an axis of rotation around which the flip-top lid 200 is moved from its closed into its opened position (being parallel to the x-axis).

The top cover element 220 comprises two flat surfaces 222, one on each side of the trench or indentation 224, which can be used as a standing surface in case the closure or the container to be attached with this closure shall be stored or placed in an upside down position.

Figure 2:
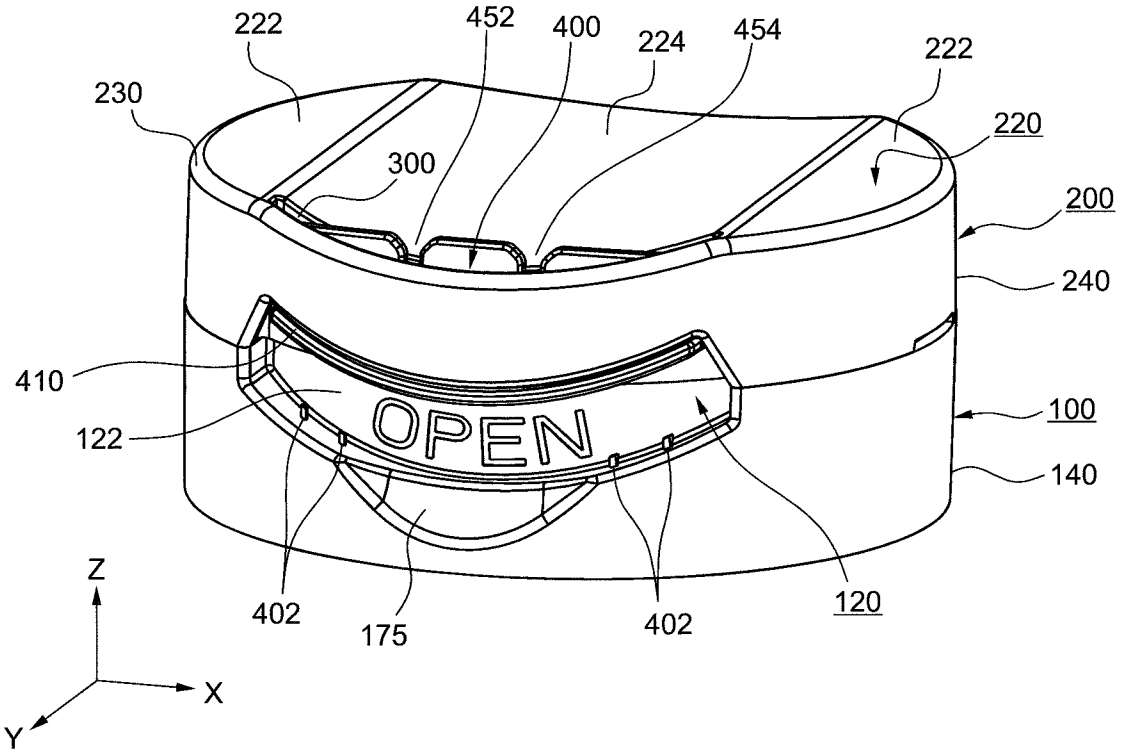
FIG. 2 shows a perspective view of the embodiment of the closure as shown in FIG. 1, however with the tamper evident element being in its second position.

As can be well seen in FIG. 1 the top cover element 220 comprises a slit 300, through which parts of the tamper evident element 400 can extend to the outside, when said tamper evident element 400 is in its second position (see FIG. 2). However, in FIG. 1 the tamper evident element is in its first position, so that the tamper evident element 400 does not extend through the slit 300. The slit 300 is curved and extends around a part of the circumference and essentially over the complete width of the indentation 224, but, in this embodiment, the slit 300 is only provided within the area where the indentation is provided and not in the area of the two flat surfaces 222.

The base element 100 is directly or indirectly attachable to a container (not shown), and the base element 100 comprises an outer side wall 140. The dimensions of the base element 100 and the flip-top lid 200 are selected such that the outer surfaces of the outer side walls 140 and 240 have the same outer diameter and therefore flush with each other.

In an area essentially opposed to the position where the hinge is arranged the base element 100 comprises a recess portion 120, extending only around a part of the circumference of said closure, in this embodiment the recess portion one 20 extends about an angle of about 80°.

The closure 10 comprises a tamper evident element 400, being linearly movable, relative to the flip-top lid, between a first position, as shown in FIG. 1, and a second position, as shown in FIG. 2. Said tamper evident element 400 comprises an actuating protrusion 410 being operated by a user to move the tamper evident element from its first position into its second position. The recess or indentation 175 in the base element 100 below a recessed portion 120 (see especially FIG. 2) enables easier access for the user to the actuating protrusion 410 for operating the device.

As can be well seen in FIG. 1 the tamper evident element 400 extends essentially completely into the recessed portion 120 of said base element 100, thereby covering part of the recessed portion 120 from view, in this embodiment essentially covering the complete recessed portion 120 from view. The tamper evident element 400 has, on its outer side, an indicator portion 422, in this embodiment bearing the wording "closed", which is fully visible when the tamper evident element 400 is in its first position as shown in FIG. 1.

The tamper evident element 400 is frangibly connected to the base element 100 via frangible bridges 402.

Figure 3:
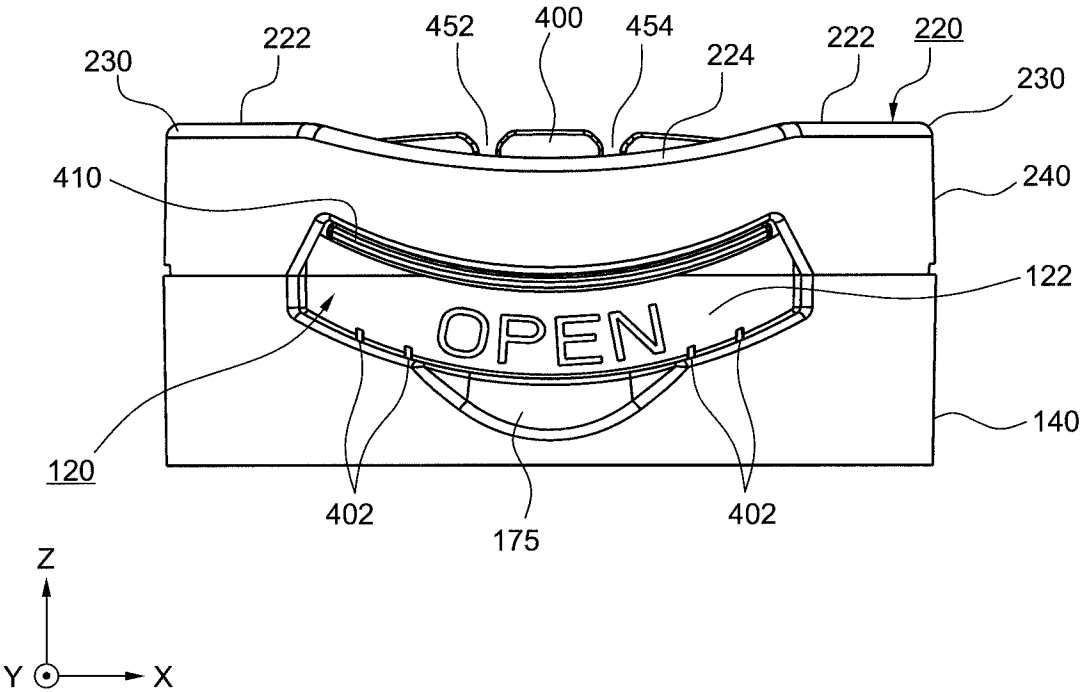
FIG. 3 shows a front view of the embodiment of the closure as shown in FIG. 2.

FIGS. 2 and 3 show the embodiment of FIG. 1, however, with the tamper evident element 400 moved into its second position. As can be well seen, the frangible bridges 402 have been destroyed when the tamper evident element 400 has been moved out of its first position.

The tamper evident element 400 has been moved out of the recessed portion 120 of the base element 100, making an indicator portion 122 of the base element 100 visible, which had been covered by the tamper evident element 400 while it has been in its first position. In this embodiment the indicator portion 122 shows the wording "open". The indicator portion 422 with the wording "closed" on the outer side of the tamper evident element 400 is now covered by the outer side wall 240 of the flip-top lid 200 and is therefore not visible anymore.

Beside the destroyed frangible bridges 402, the visible indicator portion 122 and the wording "open", the different "status" of the closure becomes especially clearly visible as the tamper evident element 400 now also extends through the slit 300 at the top cover element 220 of the flip-top lid 200 to the outside. The extension of the tamper evident element 400 to the outside of an upper area of the flip-top lid 200 is not only very well visible from nearly all directions, but is also sensible especially by fingers of a user, which is specifically helpful for blind persons or persons with restricted or poor eyesight.

As can be well seen in FIG. 3, however, the tamper evident element 400 extends through the slit only up to a height of the plane determined by the two flat surfaces 222 of the top cover element 220 or the flip-top lid 200. This has the advantage that the closure or a system with a closure and the container can be still placed or stored in an upside down position, without affecting the tamper evident element 400.

Figure 4:
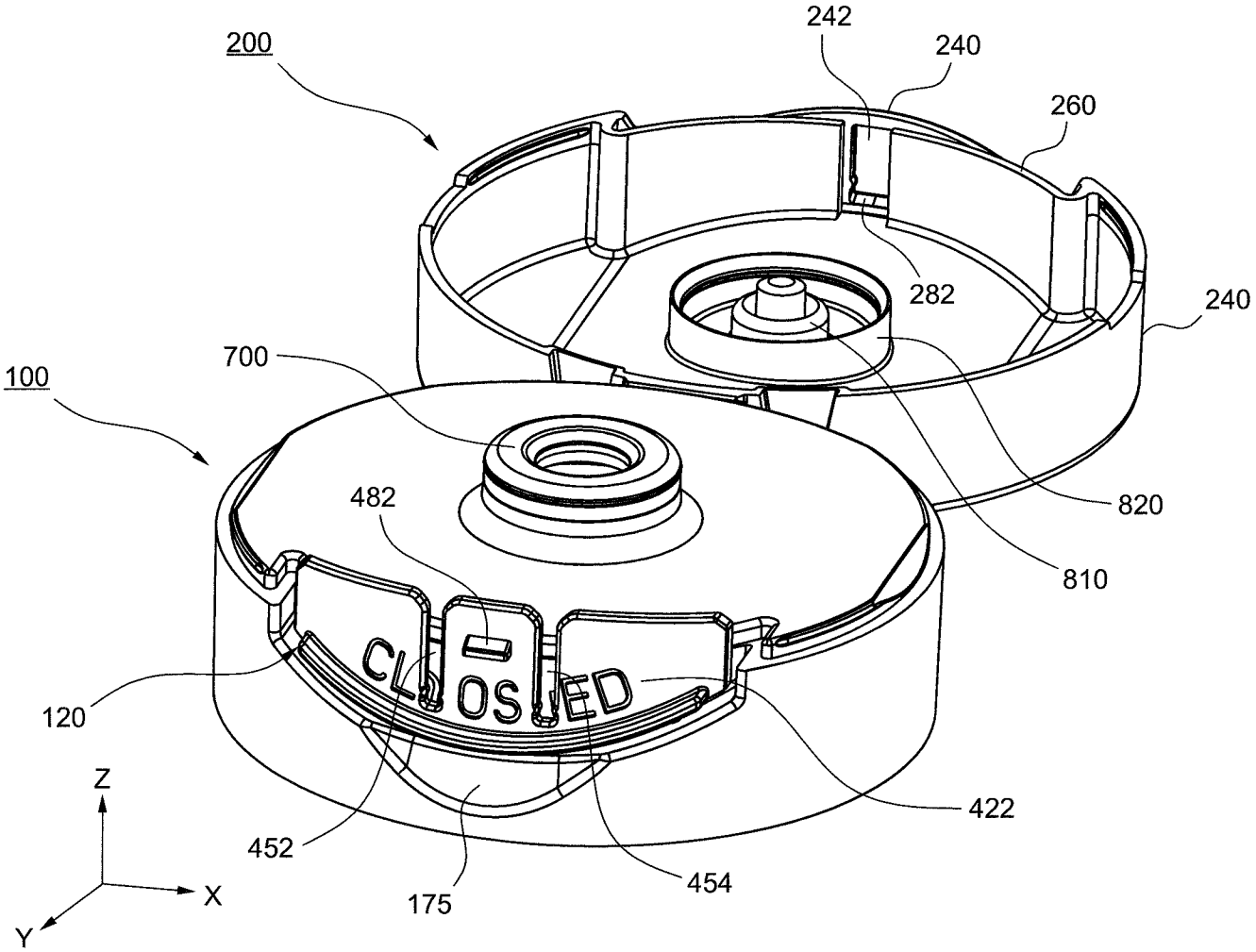
FIG. 4 shows a perspective view of the embodiment as shown in FIGS. 1 to 3 after having been molded in an open state and before the first closing of the flip-top lid during the manufacturing process.

FIG. 4 shows a perspective view of the embodiment as shown in FIGS. 1 to 3 in a status directly after having been (injection) molded in an open state and before the first closing of the flip-top lid during the manufacturing process. FIG. 4 therefore very well shows the position of the tamper evident element 400 in the recessed the portion 120 of the base element 100.

The tamper evident element 400 also comprises a first latch element 482 which can move within a corresponding guidance groove 242 provided in a radial inner surface of said outer side wall 240 of said flip-top lid 200. The longitudinally extending guidance groove 242 comprises a latching protrusion 282 which is arranged such that it interacts with the corresponding protrusion 482, acting as a first latch element, of the tamper evident element 400, when said tamper evident element 400 is in its second position. Thereby the tamper evident element 400 is attached in its second position once it is moved into this second position by the user.

The tamper evident element 400 of this embodiment comprises two longitudinally extending slits 452, 454 (essentially extending parallel to the z-axis), the function of which will be described in connection with FIG. 5.

The base element 100 comprises a spout 700 with a dispensing opening 710, and the flip-top lid 200 comprises, at the inner side thereof, an extension 810, which is inserted into the dispensing opening 710 of the spout 700, and an outer ring 820, which encloses the spout 700, when said flip-top lid 200 is in its closed position.

FIG. 5 shows the embodiment of the closure as shown in FIG. 4, however in a top view. FIG. 5 especially shows the structure of the flip-top lid 200 while, at a side essentially opposite to the side where the hinge 150 is arranged (in FIG. 5 on the right side), the flip-top lid 200 comprises an additional inner side wall 260, forming, together with parts of the outer side wall 240, a channel 310 between the outer side wall 240 and the inner side wall 260 for guiding and controlling the movement of the tamper evident element 240. The thickness of this channel 310 is adapted to the thickness of the tamper evident element 400, so that the tamper evident element 400 is guided such that it can essentially only move in a longitudinal direction linearly between its first position and its second position, avoiding or minimizing movement in other directions.

In the channel 310 there are two bridging elements 252, 254 bridging a radially inner surface of said outer side wall 240 and a radially outer surface of said inner side wall 260. These two bridging elements 252, 254 additionally guide the tamper evident element 400 having corresponding slits 452 and 454, as can be well seen in FIG. 4.

The bridging elements 252 and 254, however, not only serve as an additional control and guidance of the tamper evident element 400 in the channel 310, but the bridging elements 252 and 254 also secure that the thickness of the channel 310 is kept essentially constant over its complete extension or over most part of its extension, even if a pressure should be applied from the outside. This further ensures a proper functioning, especially a proper and controlled movement of the tamper evident element 400 within the channel 310, and it also provides additional protection against any possible manipulation of the tamper evident element 400 and the closure 10.

Figure 6:
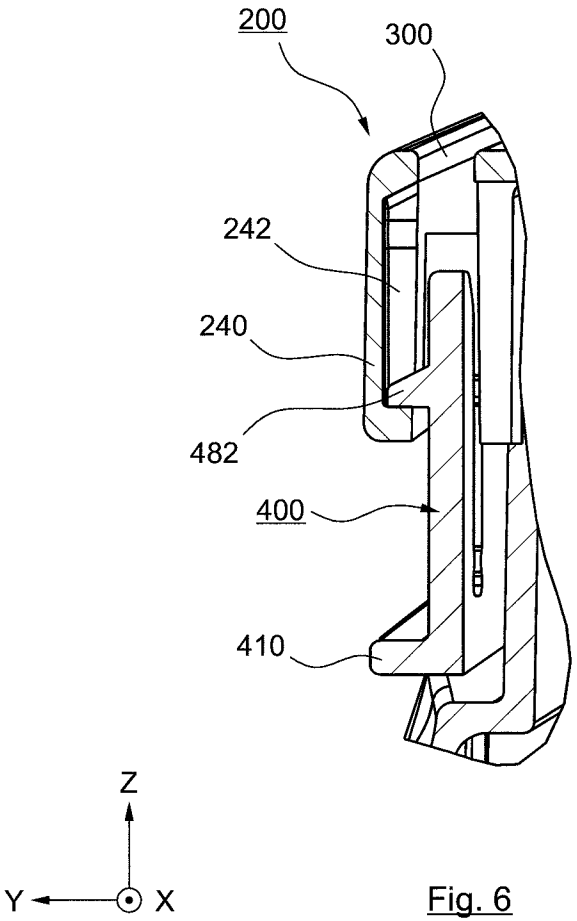
FIG. 6 shows a partial cross-sectional view of the embodiment as shown in FIG. 1 with the tamper evident element in its first position.
Figure 7:
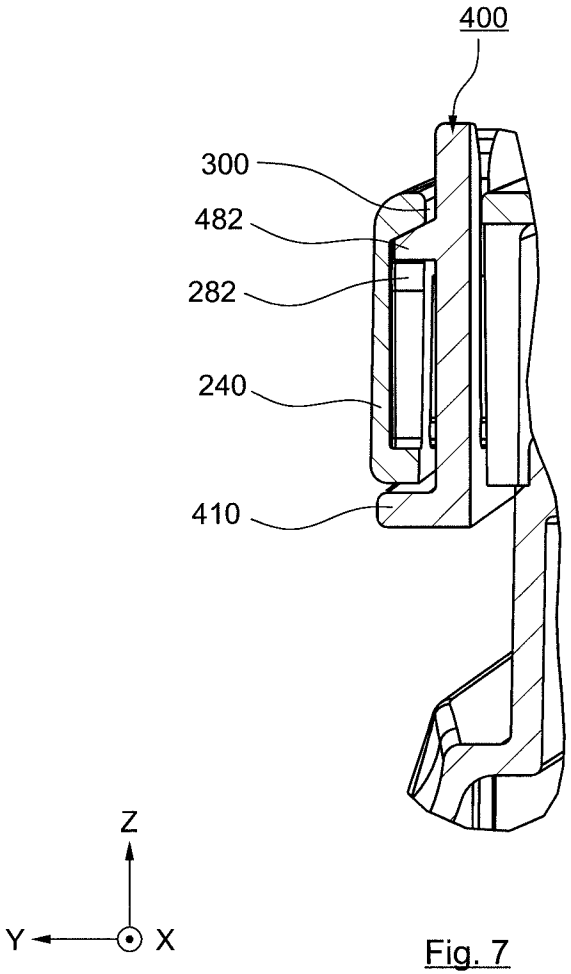
FIG. 7 shows a partial cross-sectional view of the embodiment as in FIG. 6, however with the tamper evident element being in its second position.

FIG. 6 and FIG. 7 show partial cross-sections of the embodiment of the closure, with FIG. 6 showing the tamper evident element 400 in its first position and with FIG. 7 showing the tamper evident element 400 in its second position.

As can be well seen in FIG. 6, with the tamper evident element 400 being in its first position and connected to the base element 100 via frangible bridges (not visible in this figure), so that it cannot be moved out of its position without breaking the frangible bridges, the flip-top lid 200 is also kept in its position due to the interaction of the protrusion 482 of the tamper evident element being in engagement with parts of the outer side wall 240, namely an end portion of the guidance groove 242 of the outer side wall 240, in which said protrusion 482 extends and in which it is able to move, when said tamper evident element 400 is moved from its first position (FIG. 6) into its second position (FIG. 7).

FIG. 7 shows the same partial cross-section as FIG. 6, however with the tamper evident element 400 in its second position. As can be well seen in FIG. 7, the protrusion 482 of the tamper evident element 400 abuts at the upper end of the guidance groove 242 and is kept in this position by a latching/by an interaction with a corresponding latch element 282 of said flip-top lid 200.

FIG. 7 also clearly shows how the tamper evident element 400, being in its second position, extends through the slit 300 to the outside.

Figure 8:
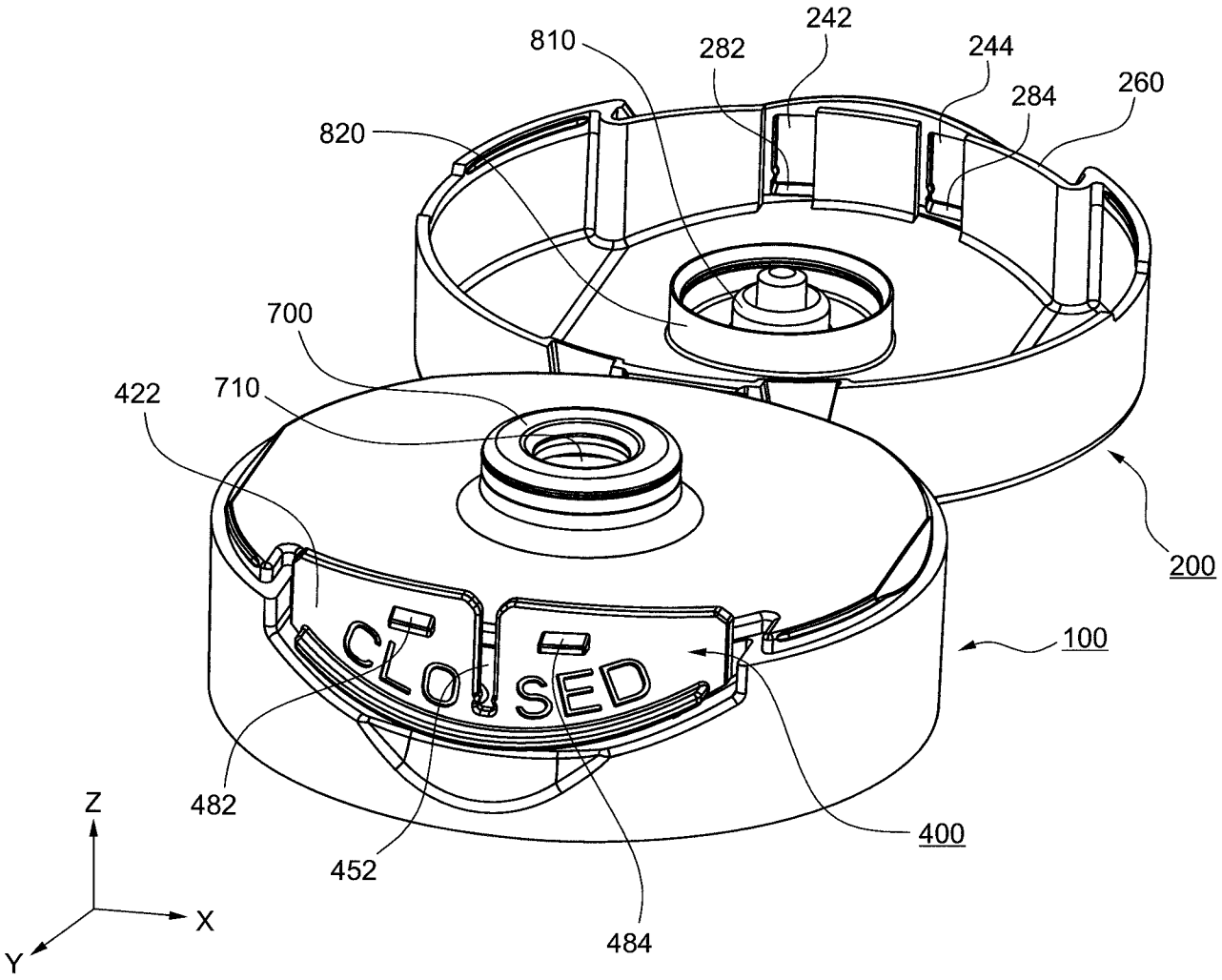
FIG. 8 shows another embodiment of the closure according to the present invention after having been molded in an open state and before the first closing of the flip-top lid during the manufacturing process (similar to FIG. 4)

FIG. 8 shows another embodiment of a closure of the present invention, which is very similar to the embodiment shown in FIGS. 1 to 7. Similar or same elements are therefore indicated with the same reference numerals and it is referred to the description in beforehand in order to avoid repetitions.

Different to the embodiment shown in the earlier figures, the embodiment shown in FIG. 8 has a different tamper evident element 400, which has only one longitudinal slit (not two slits as the first embodiment). The function, however, is similar, and also this slit 452 engages with a corresponding bridging element provided in said channel between said outer side wall 240 and said inner side wall 260 of said flip-top lid 200. Of course, in this embodiment there is therefore only one bridging element provided in said channel between said outer side wall 240 and said inner side wall 260, positioned such that it matches with the slit 452.

Furthermore, also different to the first embodiment, the tamper evident element comprises two protrusions 482 and 484 (instead of one protrusion in the first embodiment) at a radial outer side of the tamper evident element 400, and the outer side wall 240 comprises, on its radially inner surface, two corresponding guidance grooves 242 and 244 for guiding and controlling the linear movement of said tamper evident element 400.

Figure 9:
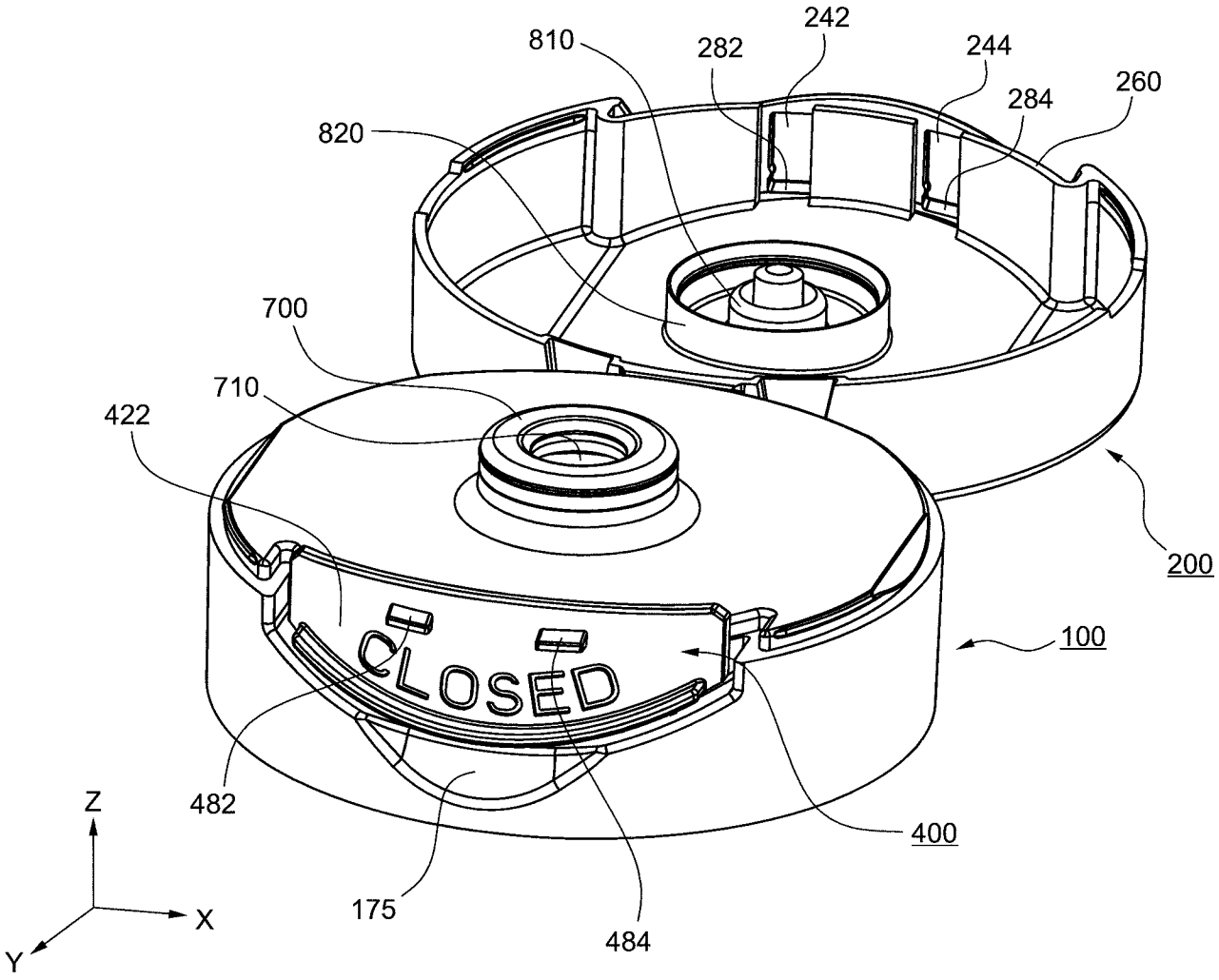
FIG. 9 shows still another embodiment of the closure according to the present invention after having been molded in an open state and before the first closing of the flip-top lid during the manufacturing process (similar to FIGS. 4 and 8).

FIG. 9 shows a still further embodiment of the closure of the present invention, which is very similar to the embodiment shown in FIG. 8. Similar or same elements are therefore indicated with the same reference numerals and it is also referred to the description in beforehand in order to avoid repetitions.

In this embodiment the tamper evident element 400 does not comprise any slit, and therefore there are also no corresponding bridging elements provided in the channel between the outer side wall 240 and the inner side wall 260 of the flip-top lid 200. Otherwise this embodiment is identical to the embodiment shown in FIG. 8.

It is clear to the expert that various amendments can be made to the embodiments without departing from the scope of the present invention as defined by the attached claims, and any features disclosed in connection with the embodiments or the general description can be important for realizing the invention, either alone or in any combination thereof.

The invention claimed is:

1. Closure for a container with a base element directly or indirectly attachable to a container, a flip-top lid attached to said base element by a hinge such that the flip-top lid can be moved between an opened and a closed position, and a tamper evident element for indicating whether the flip-top lid has been opened at least once by a user or not, said flip-top lid comprising a top cover element and an outer side wall extending therefrom, wherein said tamper evident element is movable between a first position and a second position, wherein said tamper evident element is in its first position, when said closure is in its as-manufactured status or when said flip-top lid has not been opened yet by the user, and wherein said tamper evident element is operable by a user to be moved from its first position into its second position and to concurrently move said flip-top lid for the first time from of its closed position into its opened position, characterized in that said closure is arranged such that said tamper evident element is attached to said flip-top lid and arranged such that it is linearly movable relative to said flip-top lid from its first to its second position, said flip-top lid further comprises an inner side wall, which extends only around a part of the circumference of said closure, wherein at least parts of said inner side wall and at least parts of said outer side wall together form guidance means for enabling and controlling the linear movement of said tamper evident element from its first position to its second position, wherein said tamper evident element is, in its as-manufactured status or when said flip-top lid has not yet been opened by the user, frangibly connected to said base element by at least one frangible bridge, and wherein said tamper evident element has a first latch element and said flip-top lid has a second latch element, said first latch element and said second latch element are arranged such that they keep or latch the tamper evident element in its second position once the tamper evident element has been moved into its second position for the first time.

2. Closure according to claim 1, wherein said base element has a recessed portion, extending only around a part of the circumference of said closure, wherein said closure is arranged such that said tamper evident element extends at least partly into said recessed portion of said base element, when said tamper evident element is in its first position.

3. Closure according to claim 2, wherein said closure is arranged such that said tamper evident element is at least partly retracted out of said recessed portion when being moved from its first position into its second position.

4. Closure according to claim 3, wherein said base element comprises an indicator portion being arranged in said recessed portion such that said indicator portion is not visible when said tamper evident element is in its first position but said indicator portion is visible when said tamper evident element is in its second position.

5. Closure according to claim 1, wherein a radially inner surface of said outer side wall comprises a longitudinally extending guidance groove and wherein a radially outer surface of said tamper evident element comprises a protrusion, said guidance groove and said protrusion are arranged such that said protrusion at least partly extends into said guidance groove for guiding or controlling the linear movement of said tamper evident element between its first position and its second position or for supporting such guiding or controlling.

6. Closure according to claim 5, wherein said guidance groove comprises a latching protrusion being arranged such that it interacts with said protrusion of said tamper evident element when said tamper evident element is in its second position such that said tamper evident element is latched in its second position.

7. Closure according to claim 1, wherein said outer side wall and said inner side wall of said flip-top lid are arranged such that a lower edge of either the outer side wall or of said inner side wall or a lower edge of both said outer side wall and said inner side wall abut the base element over the complete circumference of the closure, when said flip-top lid is in its closed position.

8. Closure according to claim 1, wherein said tamper evident element comprises an actuating protrusion for being operated by a user to move the tamper evident element from its first position to its second position, when opening the closure for the first time, and to move the flip-top lid out of its closed position.

9. Closure according to claim 8, wherein said actuating protrusion extends from a radially outward directed surface of said tamper evident element into a radially outward direction.

10. Closure according to claim 8, wherein said actuating protrusion extends, in a circumferential direction, over at least 70% of the circumferential extension of the tamper evident element.

11. Closure according to claim 1, wherein said flip-top lid comprises a slit being arranged such that said tamper evident element extends at least partly through said slit, when said tamper evident element is in its second position, and such that said tamper evident element does not extend through said slit, when said tamper evident element is in its first position.

12. Closure according to claim 1, wherein said flip-top lid comprises a slit being arranged such that said tamper evident element extends at least partly into said slit but not through said slit, when said tamper evident element is in its second position, and such that said tamper evident element does not extend into said slit, when said tamper evident element is in its first position, or alternatively wherein said flip-top lid comprises a slit being arranged such that said tamper evident element is moved closer to said slit when being moved from its first position to its second position without extending into said slit or through said slit.

13. Closure according to claim 11, wherein said tamper evident element comprises at least one additional latching element, which interacts with a part or parts of said flip-top lid, such that a latching effect is achieved, latching or keeping the tamper evident element in its second position, once the tamper evident element has been moved into its second position for the first time.

14. Closure according to claim 1, wherein said top cover element of said flip-top lid comprises a deepening or indentation extending over a portion of said top cover element.

15. Closure according to claim 14, wherein said flip-top lid comprises a slit being arranged such that said tamper evident element does extend at least partly through said slit or alternatively does extend into said slit but not through said slit, when said tamper evident element is in its second position, and such that said tamper evident element does not extend through said slit, when said tamper evident element is in its second position, wherein said through hole or slit is at least partly arranged within said deepening or indentation.

16. Closure according to claim 15, wherein said closure is arranged such that the tamper evident element extends, when being in its second position, through said slit alternatively into said slit only in said deepening or indentation of said flip-top lid.

17. Closure according to claim 1, wherein said top cover element of said flip-top lid comprises at least one flat surface forming a standing surface or a platform for allowing a closure or a container connected to said closure to be arranged in an upside down position.

18. Closure according to claim 17, wherein the closure is arranged such that said tamper evident element extending at least partly through a slit in said flip-top lid when being in its second position does not extend beyond the plane defined by said at least one flat surface of said top cover element when being in its second position.

19. Closure according to claim 14, wherein said deepening or indentation has the form of a trench extending radially over the complete top cover element.

20. Closure according to claim 1, wherein said parts of said inner side wall and said parts of said outer side wall together form the guidance means and a channel in which said tamper evident element can be moved, wherein there is at least one bridging element provided in said channel and connecting said inner side wall and said outer side wall, wherein said tamper evident element has at least one corresponding slit through which said at least one bridging element extends.

21. Closure according to claim 1, wherein said tamper evident element comprises an indicator portion being arranged at a radial outer surface of said tamper evident element such that said indicator portion of said tamper evident element is visible when said tamper evident element is in its first position and which is not visible and covered by the outer side of said flip-top lid, when said tamper evident element is in its second position.

22. Container with a closure according to claim 1, wherein said closure is attached to or attachable to the container or wherein said closure is integrally formed with the container or part of the container.

23. Method for manufacturing a closure according to claim 1, wherein said base element and said flip-top lid are manufactured by injection molding and in an open status with said flip-top lid being in its opened position.

* * * * *